US007701400B2

(12) United States Patent
Su et al.

(10) Patent No.: US 7,701,400 B2
(45) Date of Patent: Apr. 20, 2010

(54) ANTENNA ASSEMBLY WITH A MOVEABLE ANTENNA

(75) Inventors: Wen-Fong Su, Tu-Cheng (TW); Lung-Sheng Tai, Tu-Cheng (TW); Yao-Shien Huang, Tu-Cheng (TW); Yu-Lung Shih, Tu-Cheng (TW); Li-Heng Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 336 days.

(21) Appl. No.: 11/890,954

(22) Filed: Aug. 8, 2007

(65) Prior Publication Data

US 2008/0036684 A1 Feb. 14, 2008

(30) Foreign Application Priority Data

Aug. 8, 2006 (TW) ..... 95128971 A

(51) Int. Cl.
*H01Q 1/24* (2006.01)

(52) U.S. Cl. ..... 343/702

(58) Field of Classification Search ..... 343/702, 343/700 MS

See application file for complete search history.

(56) References Cited

U.S. PATENT DOCUMENTS 6,239,765 B1 * 5/2001 Johnson et al. ..... 343/795
2001/0052879 A1 * 12/2001 Gunee et al. ..... 343/702
2007/0096995 A1 * 5/2007 Lee ..... 343/702

* cited by examiner

*Primary Examiner*—Trinh V Dinh
*Assistant Examiner*—Dieu Hien T Duong
(74) *Attorney, Agent, or Firm*—Wei Te Chung; Andrew C. Cheng; Ming Chieh Chang

(57) ABSTRACT

An antenna assembly with a movable antenna, assembled on an electronic device, includes a fixed portion adapted for assembling to said electronic device, an active portion movably assembled to the fixed portion and receiving the antenna therein, a first guiding means is served by some guiding slots formed on one of the fixed portion and the active portion and some guiding tabs corresponding to the guiding slots and formed on one of the active portion and the fixed portion; wherein the movable antenna capable of moving between a close position and an open position, and said guiding tabs are capable of sliding along the guiding slots and being stopped by the guiding slots to achieve the open position and close position of the antenna.

12 Claims, 4 Drawing Sheets

ANTENNA ASSEMBLY WITH A MOVEABLE ANTENNA

BACKGROUND OF THE INVENTION

1. Field of the Invention

The present invention relates generally to an antenna assembly, and more particularly to an antenna assembly with a moveable antenna assembling on an electronic device, such as notebook.

2. Description of the Prior Art

Since the wireless communication technology of using electromagnetic wave to transmit signals has the effect of remote device transmission without cable connection, and further has the mobility advantage, therefore the technology is widely applied to various products, such as moveable phones, notebook computers, intellectual home appliance with wireless communication features. Because these devices use electromagnetic wave to transmit signals, the antenna used to receive electromagnetic wave also becomes a necessity in the application of the wireless communication technology. An antenna almost requires to receive and send signals in different directions. But the radiating performance of antennas inside the electronic devices is dissatisfactory due to the influence of components in the electronic devices. Outer antennas can eliminate the trouble, but the outer antennas can not achieve the handsome requirement of present designs of the electronic devices.

Hence, an improved antenna assembly with a moveable antenna is desired to overcome the above-mentioned shortcomings of the existing antennas.

BRIEF SUMMARY OF THE INVENTION

A primary object, therefore, of the present invention is to provide an antenna assembly with an small-size simple-structure inner antenna which is able to move away from an electronic device and back to be received in the electronic device.

In order to implement the above object and overcomes the above-identified deficiencies in the prior art, the antenna assembly with a movable antenna adapted for mounting to an electronic device, comprises a fixed portion adapted for assembling to said electronic device, an active portion movably assembled to the fixed portion and receiving the antenna therein, a first guiding means is served by some guiding slots and some guiding tabs corresponding to the guiding slots; wherein the movable antenna is capable of moving between a close position and an open position and the guiding tabs are capable of sliding along the guiding slots and being stopped by the guiding slots to achieve the open position and close position of the antenna.

In order to implement the above object and overcomes the above-identified deficiencies in the prior art, the antenna assembly with a movable antenna, assembled on an electronic device, comprises a fixed portion adapted for assembling to said electronic device, an active portion movably assembled to the fixed portion and receiving the antenna therein, a first guiding means is served by some guiding slots formed on one of the fixed portion and the active portion and some guiding tabs corresponding to the guiding slots and formed on one of the active portion and the fixed portion; wherein the movable antenna capable of moving between a close position and an open position, and said guiding tabs are capable of sliding along the guiding slots and being stopped by the guiding slots to achieve the open position and close position of the antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
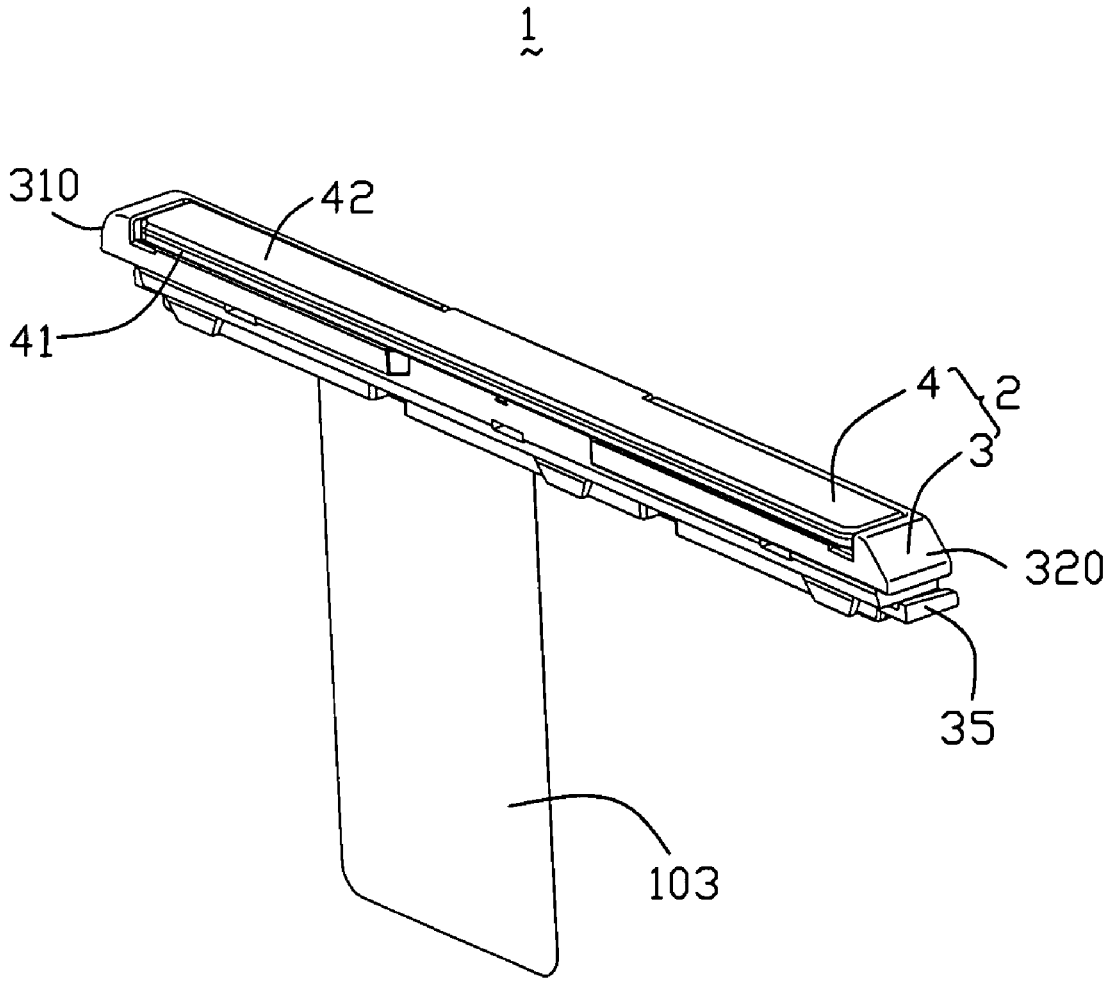
FIG. 1 is a perspective view illustrating a preferred embodiment of an antenna assembly with a movable antenna of the present invention assembled on an electronic device.
Figure 2:
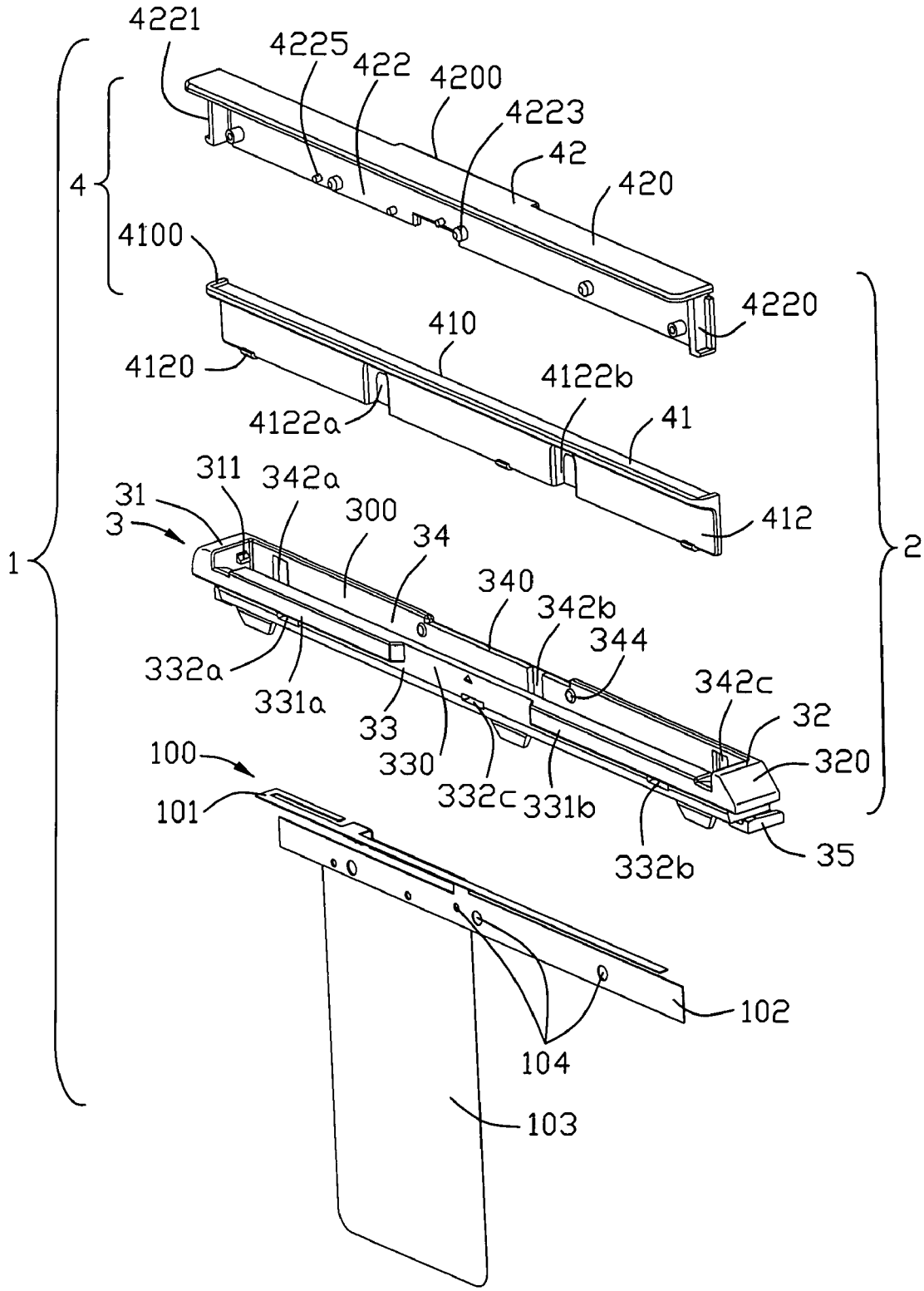
FIG. 2 is a exploded, perspective view of the FIG. 1.
Figure 3:
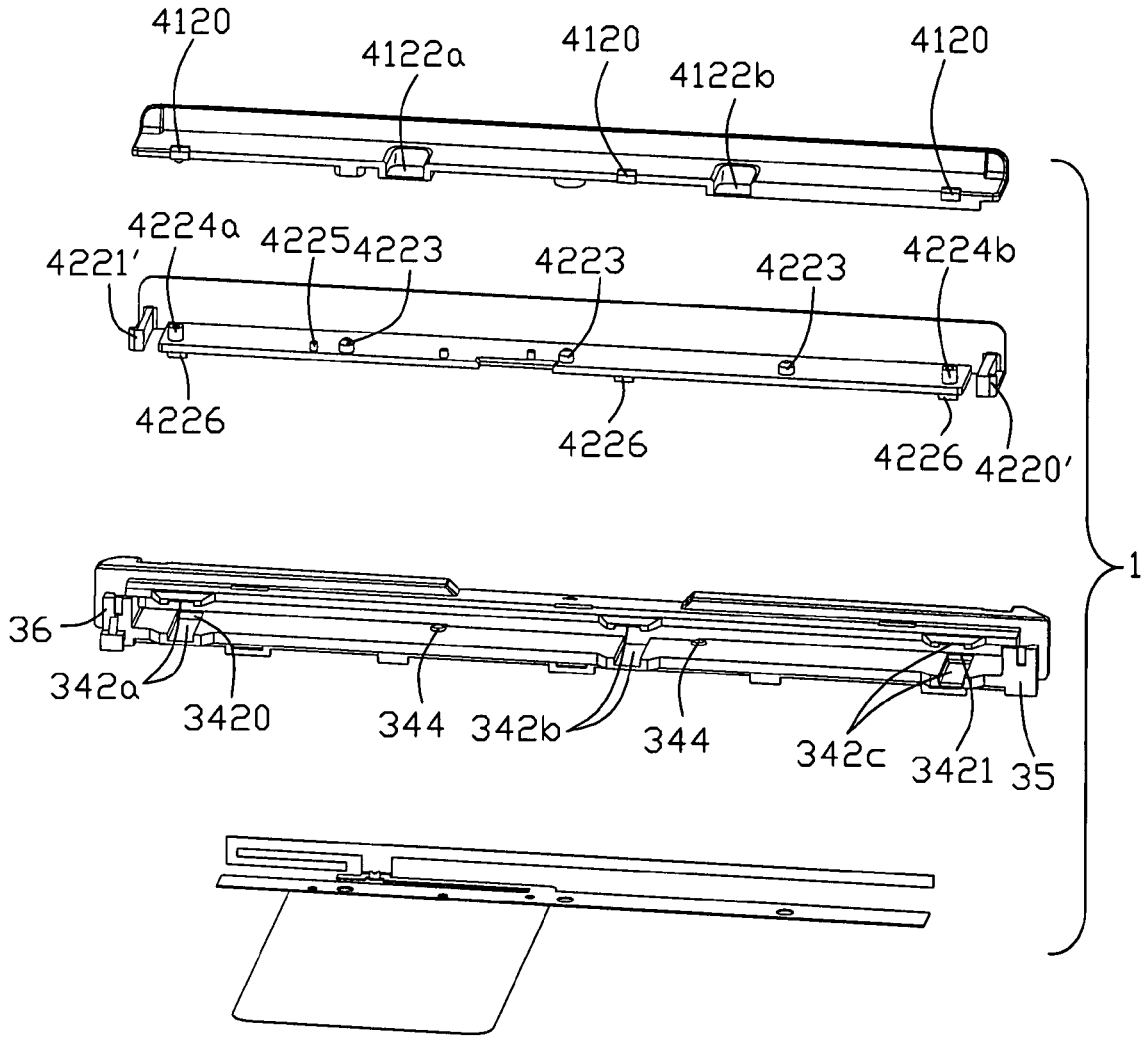
FIGS. 3-4 are views similar to FIG. 2, but viewed from different angles.
Figure 4:
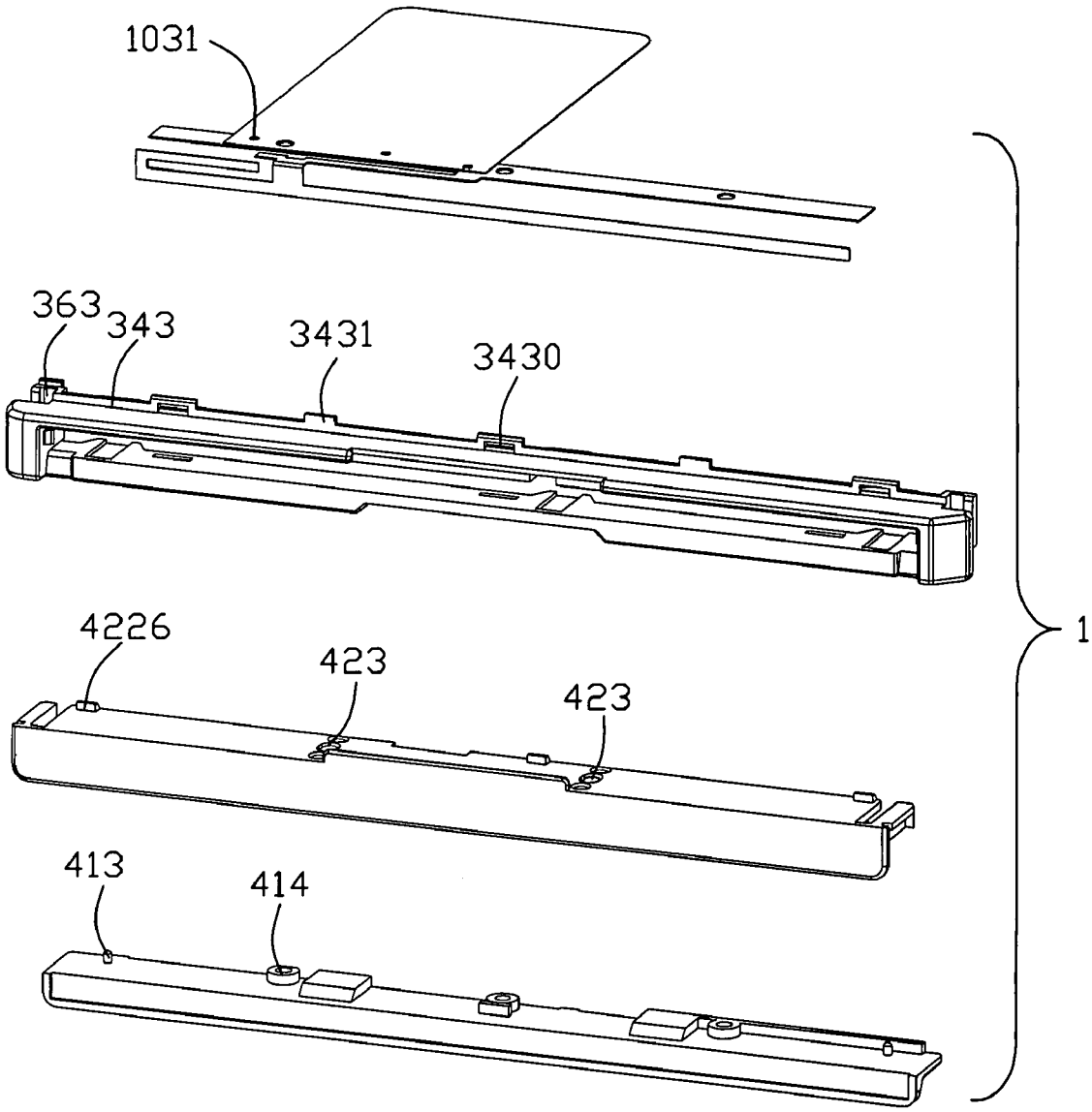

Reference to FIG. 1, an assembled, perspective view of an antenna assembly 1 in accordance with a preferred embodiment of the present invention is shown. Reference to FIGS. 2-4 shows exploded, perspective views of FIG. 1, but viewed from different angles.

The antenna assembly 1 is assembled in a mobile electronic device, such as a notebook computer, and movably received in a groove (not shown) defined by an edge of the movable electronic device. The antenna assembly 1 comprises an antenna 100, an insulative cover 2 used to receive the antenna 100 and fix the antenna assembly 1 in the electronic device.

The antenna 100 is a planar inverted-F antenna, and comprises a radiating element 101, a grounding element 102 and a grounding prolongation 103. The grounding element 102 has some installing apertures 104 with different sizes. The radiating element 101 is located on a plane perpendicular to a plane on which the grounding portion 102 is located. The grounding prolongation 103, pasted on the grounding element 102, has some holes 1031 aligning with corresponding installing apertures 104 on the superposition between the grounding portion 102 and the grounding prolongation 103.

The insulative cover 2 comprises a fixed portion 3 and an active portion 4. The fixed portion 3 comprises a groove 300 defined by a first side wall 31, an opposite second side wall 32, a third side wall 33 and a fourth side wall 34 to receive the active portion 4, and a pair of latches 35, 36 to fasten the fixed portion 3 to the electronic device. The first side wall 31 has an arc surface 310 and a first protrusion 311 extending from the inner surface of the first side wall 31 into the groove 300. The second side wall 32 comprises a bevel 320 and a second protrusion (not labeled) extending from the second side wall 32 and opposite to the protrusion 311. The third side wall 33 comprises a pair of ribs 331*a*, 331*b* protruding outwardly the outer surface of the third side wall 33 and a concave portion 330 defined between the two ribs 331*a*, 331*b*. Three slots 332*a*, 332*b*, 332*c* are spaced arranged in the third side wall 33 and below the pair of ribs 331*a*, 331*b* and the concave portion 330. The fourth side wall 34 has a sunken surface 340 on the top thereof. Three pairs of guiding slots 342*a*, 342*b*, 342*c* are defined on the inner surfaces of the third side wall 33 and the fourth side wall 34 respectively, and both of the same pair of the guiding slots are face to face. The pair of guiding slots 342*b* are respectively on the middle of the inner surfaces of the third side wall 33 and the fourth side wall 34. The pair of guiding slots 342*a* and the pair of guiding slots 342*c* are located at the two sides of the guiding slots 342*b* and two pairs of stop sections 3420, 3421 are respectively formed on the guiding slots 342*a* and 342*b*. A pair of columns 344 extend from the inner surface of the fourth side wall 34 on the two different sides of the guiding slot 342*b*. A bar 343 extends from the outer surface of the fourth side wall 34 and forms some protuberant rectangular frames 3430 and some protuberant rectangular pieces 3431. A first latch 36 extends from the first side wall 31 and a second latch 35 extends from the second side wall 32 which together form latch means. The first latch 36 has a shape different from the shape of the second latch 35, and both of the first latch 36 and the second latch 35 are used to fix the fixed portion 3 with the active portion 4 and the antenna 100 to an electronic device.

The active portion 4 comprises a front piece 41 and a rear piece 42. The front piece 41 comprises an upper wall 410 located in a horizontal plane and a vertical wall 412 downwardly extending from a rear edge of the upper wall 410. The upper wall 410 has a bar 4100 extending from the three continuous edges of the top of the upper wall 410 upwardly. A pair of fixed grooves 4122*a*, 4122*b* are recessed rearwardly from front surface of the vertical wall 412. The vertical wall 412 forms three front guiding tabs 4120 extending forwardly from lower edge thereof and corresponding to the guiding slots 342*a*, 342*b*, 342*c* on the third side wall 33 of the fixed portion 3. The rear piece 42 comprises an upper patch 420 and a vertical patch 422. The upper patch 420 has a holding portion 4200 which fit in the sunken surface 340 of the fixed portion 3 to receive itself into the sunken surface 340. The vertical patch 422 has a pair of guiding portions 4220, 4221 respectively on the two sides thereof, three first tubes 4223 on the surface thereof, a pair of second tubes 4224*a*, 4224*b*, some sticks 4225 and some rear guiding tabs 4226 corresponding to the rear guiding slots 342*a*, 342*b*, 342*c* on the fourth side wall 34 of the fixed portion 3. Blocking faces 4220' and 4221' are respectively defined by the guiding portions 4220 and 4221. The guiding portions 4220, 4221 respectively correspond to the first protrusion 311 and the second protrusion of the fixed portion 3 to be served as first guiding means of the insulative cover 2. The front guiding tabs 4120 and the rear guiding tabs 4226 of the active portion 4 respectively correspond to the guiding slots 342*a*, 342*b*, 342*c* of the fixed portion 3 to be served as second guiding means of the insulative cover 2. The front piece 41 has the posts 414 corresponding to the first tubes 4223 of the rear piece 42 and two sticks 413 corresponding to the second tubes 4224*a*, 4224*b*. The posts 414 and the sticks 413 are served as a first connecting portion of the front piece 41. The first tubes 4223, the pair of second tubes 4224*a*, 4224*b* of the rear piece 42 are served as a second connecting portion. The first connecting portion of the front piece 41 corresponding to the second connecting portion of the rear piece 42 to assemble the front piece 41 with the rear piece 42. The vertical patch 422 has some holes 423 corresponding to the pair of columns 344.

In assembly, the sticks 4225 of the vertical patch 422 of the rear piece 42 go through the small-size installing apertures 104 of the antenna 100. And then, the first tubes 4223 go through the big-size installing apertures 104 to fix the antenna 100 on the rear piece 42. The first tubes 4223 are respectively correspondingly inserted to the posts 414 and the sticks 413 are respectively correspondingly inserted to the second tubes 4224*a*, 4224*b* to assemble the front piece 41 with the rear piece 42 to form the active portion 4 with the antenna 100 there between. At the same time, the fixed grooves 4122*a*, 4122*b* abut against the grounding element 102 of the antenna 100 to make the antenna 100 abut against the rear piece 42 without replacement. Afterward, the active portion 4 is assembled with the fixed portion 3. The three front guiding tabs 4120 and the three rear guiding tabs 4226 are respectively inserted into the three pair of guiding grooves 342*a*, 342*b*, 342*c*. The protrusions 311 of the fixed portion 3 are respectively infixed in the guiding portions 4220, 4221 of the rear piece 42. Finally, the fixed portion 3 is assembled on a cover of the electronic device, wherein the fixed portion 3 is fixed in the groove of the electric device, the upper wall 410 of the front piece 41 and the upper patch 420 of the rear piece 42 is on a plane same as one surface of the cover, and the grounding prolongation 103 extends outward the insulative cover 2 to be received in the inner space of the electronic device. When working, the active portion 4 is able to be pulled outward relatively the fixed portion 3 to its open position to make the antenna 100 in a good environment with smaller Electro Magnetic Interference produced by the components in the electronic device. When the active portion 4 pressed downwardly to be received in the groove of the electronic device, the antenna returns to its close position.

In other embodiment of the present invention, the fixed portion 3 can be canceled, and the active 4 is assembled on the cover of the electronic device with some guiding portions corresponding to each other to make the active portion 4 movable.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An antenna assembly with a movable antenna adapted for mounting to an electronic device, comprises:

the movable antenna capable of moving between a close position and an open position;

a fixed portion adapted for assembling to said electronic device;

an active portion movably assembled to the fixed portion and receiving the antenna therein;

a first guiding means is served by some guiding slots formed on one of the fixed portion and the active portion and some guiding tabs corresponding to the guiding slots and formed on one of the active portion and the fixed portion;

wherein said guiding tabs are capable of sliding along the guiding slots and being stopped by the guiding slots to achieve the open position and close position of the antenna;

wherein said guiding slots are defined on the fixed portion and the guiding tabs are defined on the active portion;

wherein said guiding tabs of the active portion comprises some front guiding tabs and some rear guiding tabs, all of which respectively correspond to the guiding slots of the fixed portion.

2. The antenna assembly as claimed in claim 1, wherein said active portion together with the antenna flatly moves along the axes of the fixed portion.

3. The antenna assembly as claimed in claim 1, wherein said fixed portion comprises a pair of latches to form a latching means to fix the fixed portion to the electronic device.

4. The antenna assembly as claimed in claim 3, wherein said pair of latches have different shapes.

5. The antenna assembly as claimed in claim 1, wherein said active portion comprise two pieces to form a space receiving the antenna and the active portion is movably receive in the fixed portion.

6. The antenna assembly as claimed in claim 5, wherein said two pieces of the active portion is assembled together by interferentially engaging some posts and sticks defined by a front piece with some tubes defined by a rear piece.

7. The antenna assembly as claimed in claim 6, wherein both said front piece and said rear piece comprise an upper portion and a vertical portion forming a certain angle with to the upper portion.

8. The antenna assembly as claimed in claim 7, wherein said antenna comprises a radiating portion located between the two upper portions and a grounding portion located between the two vertical portions.

9. An antenna assembly with a movable antenna adapted for mounting to an electronic device, comprises:

the movable antenna capable of moving between a close position and an open position;

a fixed portion adapted for assembling to said electronic device;

an active portion movably assembled to the fixed portion and receiving the antenna therein;

a first guiding means is served by some guiding slots formed on one of the fixed portion and the active portion and some guiding tabs corresponding to the guiding slots and formed on one of the active portion and the fixed portion;

wherein said guiding tabs are capable of sliding along the guiding slots and being stopped by the guiding slots to achieve the open position and close position of the antenna;

wherein said guiding slots are defined on the fixed portion and the guiding tabs are defined on the active portion;

wherein said fixed portion comprises a first protrusion and a second protrusion, the active portion comprises a guiding portion, which three together form a second guiding means.

10. The antenna assembly as claimed in claim 9, wherein said fixed portion comprises a channel formed by a first side wall, an opposite second side wall, a third side wall and a fourth side wall.

11. The antenna assembly as claimed in claim 10, wherein said first protrusion and said second protrusion are respectively oppositely on the inner surfaces of the first side wall and the second side wall.

12. The antenna assembly as claimed in claim 10, wherein said guiding slots are oppositely on the inner surface of the third side wall and the fourth side wall.

* * * * *